US005619970A

United States Patent [19]

Collingborn

[11] Patent Number: 5,619,970

[45] Date of Patent: Apr. 15, 1997

[54] FUEL PUMPING APPARATUS

[75] Inventor: Peter A. G. Collingborn, Kent, England

[73] Assignee: Lucas Industries, Public. Limited Company, England

[21] Appl. No.: 644,321

[22] Filed: May 10, 1996

[30] Foreign Application Priority Data

May 13, 1995 [GB] United Kingdom ..... 9509733

[51] Int. Cl.[6] ..... F02M 41/00; F02M 7/00

[52] U.S. Cl. ..... 123/447; 123/450

[58] Field of Search ..... 123/500, 501, 123/447, 450, 506

[56] References Cited

U.S. PATENT DOCUMENTS 5,363,824 11/1994 Bonse ..... 123/506

5,462,028 10/1995 Buckley ..... 123/447

5,564,394 10/1996 Wood ..... 123/450

*Primary Examiner*—Thomas N. Moulis

*Attorney, Agent, or Firm*—Andrus, Sceales, Starke & Sawall

[57] ABSTRACT

An accumulator type fuel injection system has a cam actuated plunger pump for charging an accumulator chamber with fuel under pressure and valve means which in one position connects the accumulator chamber with a fuel delivery passage to cause delivery of fuel and in its other position to connect the delivery passage to a drain channel to terminate delivery of fuel. The drain channel includes a restrictor. The system includes a piston slidable in a cylinder having one end connected to the plunger pump through a valve and to the outlet of a low pressure pump. The other end of the cylinder is connected to the drain channel upstream of the restrictor. The piston acts to displace fuel in the one end of the cylinder to the plunger pump when the valve means is moved to its second position.

6 Claims, 1 Drawing Sheet

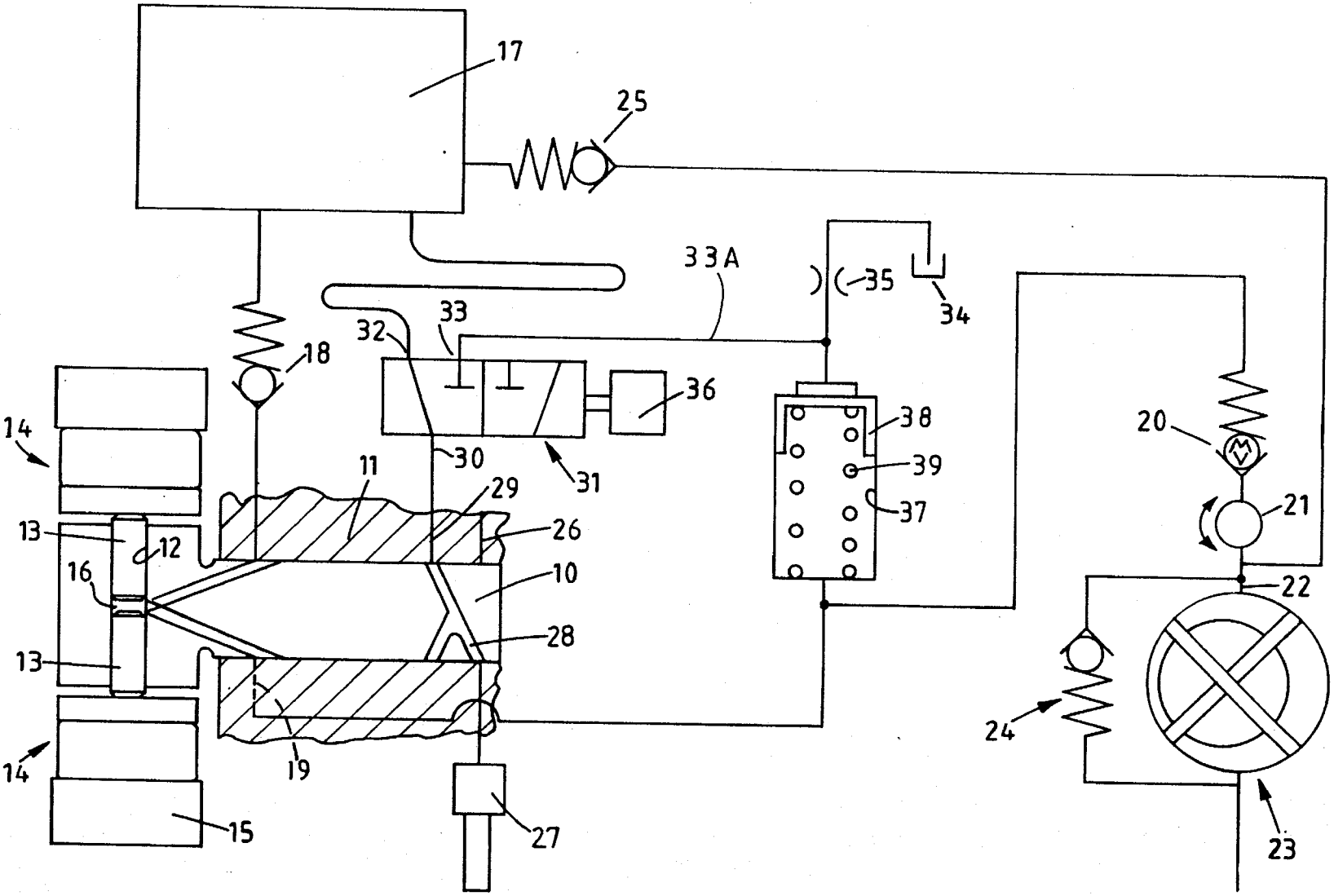
17
25
33A
34
35
36
31
33
32
30
29
26
10
28
27
11
18
19
15
12
16
13
13
14
14
20
21
22
23
24
38
39
37

FUEL PUMPING APPARATUS

This invention relates to a fuel pumping apparatus for supplying fuel to an internal combustion engine and of the kind comprising an accumulator chamber, a rotary distributor member housed within a body, a delivery passage formed in the distributor member, the delivery passage registering with outlet ports in turn as the distributor member rotates, valve means positioned in a passage connecting said delivery passage with the accumulator chamber, said valve means in a first position connecting the accumulator chamber to the delivery passage to cause delivery of fuel through one of said outlet ports to the associated engine and in a second position breaking the communication with the accumulator chamber and establishing communication between the delivery passage and a drain channel, a cam actuated plunger pump for charging the accumulator chamber with fuel under pressure, a first valve for connecting the plunger pump to the accumulator chamber, a second valve through which fuel can be supplied to the plunger pump, a low pressure pump which supplies fuel by way of the second valve to the pumping chamber and means for varying the volume of fuel which is supplied to the plunger pump.

Such an apparatus is seen in EP-A-0643221. The delivery of fuel to the engine is under the control of the aforesaid valve means which is preferably an electromagnetically operable valve and the delivery of fuel to the engine may take place at any time during the cycle of operation of the plunger pump. The filling of the pumping chamber of the plunger pump can only take place between successive delivery strokes of the plunger or plungers and this means that the low pressure pump must be of a capacity which can ensure the required degree of filling of the pumping chamber within the time available. When fuel is not being supplied to the plunger pump, the fuel delivered by the low pressure pump is spilled and this represents a loss of energy. There is also a substantial loss of energy when the valve means is moved to its second position because at this time depressurization of the fuel in the fuel column extending through the outlet port to the injection nozzle of the engine takes place.

The object of the present invention is to provide an apparatus of the kind specified in an improved form.

According to the invention an apparatus of the kind specified includes a cylinder, a piston slidable within the cylinder, one end of the cylinder being connected to the pumping chamber of the plunger pump through said second valve and the other end of the cylinder being connected to said drain channel, the apparatus including flow restricting means in said drain channel downstream of the connection with said other end of the cylinder, the apparatus being arranged so that said valve means is operated to terminate delivery of fuel to the engine during the period when said second valve is open.

An example of an apparatus in accordance with the invention will now be described with reference to the accompanying diagrammatic drawing.

The apparatus comprises a rotary distributor member 10 which is housed within a surrounding body 11 and which in use, is driven in timed relationship with the associated engine. The distributor member extends from the body and is of enlarged form and defines a diametrically extending bore 12 in which is mounted a pair of pumping plungers 13. At their outer ends, the plungers are engaged by cam followers 14 respectively which include rollers engageable with the internal peripheral surface of an annular cam ring 15. On the internal peripheral surface of the cam ring 15 there is formed a plurality of equi-angularly spaced cam lobes (not shown) equal in number to the number of engine cylinders.

The inner ends of the pumping plungers together with the surrounding portion of the bore 12, form a pumping chamber 16 which communicates with an accumulator chamber 17 directly by way of a first valve in the form of a non-return valve 18.

Fuel is supplied to the pumping chamber 16 by way of a second valve defined by an inlet port 19 and passages formed in the distributor member which communicate with the pumping chamber, the port communicating with the passages in turn during the periods when the plungers 13 are allowed to move outwardly by the cam lobes. The inlet port 19 is connected by way of a non-return valve 20 and a metering valve 21 connected in series, with the outlet 22 of a low pressure pump 23 conveniently of the vane type and having its rotor coupled to the distributor member 10. The outlet pressure of the low pressure pump is controlled by a relief valve 24. The outlet 22 of the low pressure pump is also in communication with the accumulator chamber 17 by way of a non-return valve 25.

Formed in the housing 11 is a plurality of outlets 26 which communicate with injection nozzles 27 respectively mounted on the associated engine and formed in the distributor member is a delivery passage 28 which by way of further passages in the distributor member is brought into communication with a high pressure fuel inlet port 29 formed in the housing. The inlet port 29 communicates with the common port 30 of a two position three way valve 31. One of the alternative ports of the valve identified by the reference numeral 32, is connected to the accumulator chamber and the other alternative port identified by the reference numeral 33, is connected through a drain channel 33A, to a drain 34 by way of a restrictor 35.

The valve 31 is controlled by an actuator 36 which is under the control of an electronic control system which is responsive to various engine operating parameters and desired operating parameters. The control system also controls the operation of the metering valve 21 in response to the signal provided by a sensor responsive to the pressure in the accumulator chamber.

Consider now the operation of the apparatus so far described. The high pressure pump serves to charge the accumulator chamber 17 with fuel and this it does as the distributor member rotates and during the inward movement of the plungers 13. As the plungers move inwardly fuel is discharged to the accumulator chamber by way of the non-return valve 18. The pressure in the accumulator chamber is monitored by the aforesaid sensor and the valve 21 is controlled so as to vary the quantity of fuel which is supplied to the high pressure pump. As the distributor member rotates the delivery passage 28 is brought into register with an outlet 26 and the valve 31 is moved to the position shown from its alternative position, to permit fuel from the accumulator chamber to flow to the selected outlet 26 and through the associated fuel injection nozzle 27 to an engine combustion chamber. When sufficient fuel has been delivered the valve 31 is moved to its alternative position in which the port 32 is closed and the port 30 connected to the port 33. This has the effect of terminating delivery of fuel to the engine and also lowers the pressure over a short period, in the fuel column which extends between the valve 31 and the injection nozzle. As the distributor member rotates, further fuel is delivered to the accumulator chamber and when the valve 31 is operated fuel is supplied to the following injection nozzle.

The high pressure pump can only be filled during the time when the plungers are allowed to move outwardly by the cam lobes which means that the low pressure pump must be capable of filling the high pressure pump to its maximum extent when the engine is operating at full load, in the time available. For the remaining time the fuel delivered by the low pressure pump is returned by the pressure control valve to the inlet of the pump. Apart from the fact that the low pressure pump must be physically large enough to provide the necessary pumping capacity, the fuel which is delivered in the times between successive filling strokes of the high pressure pump is wasted and this represents a considerable loss of energy. There is also a substantial loss of energy when the pressure in the fuel column is reduced to drain pressure.

In order to at least partially overcome these disadvantages, there is additionally provided a cylinder 37 in which is housed a piston 38. One end of the cylinder is connected to the inlet port 19 and the other end of the cylinder is connected to the drain channel 33A upstream of the restrictor 35. The piston is biased by a spring 39 towards the other end of the cylinder. In use, the low pressure pump can deliver fuel to the one end of the cylinder to allow displacement of the piston 38 during the period when the inlet port 19 is out of communication with the pumping chamber 16. The volume of fuel which is admitted to the one end of the cylinder depends upon the setting of the metering valve 21. Moreover, it is arranged that the inlet port 19 is open to the pumping chamber 16 when the valve 31 is operated to halt the supply of fuel to the associated engine. As previously mentioned, in the alternative position of the valve the port 30 is connected to the port 33 and the flow of fuel attendant upon the depressurisation of the fuel column due to the action of the restrictor 35, takes place into said other end of the cylinder 37. This has the effect of causing displacement of the piston 38 against the action of the spring 39 and a transfer of fuel from the one end of the cylinder to the pumping chamber of the high pressure pump. In this manner some of the energy which would otherwise be lost, is recovered and is utilised to transfer cool fuel to the pumping chamber. The action of the valve 20 is to prevent fuel from the one end of the cylinder being displaced towards the low pressure pump rather than the high pressure pump during the period of movement of the piston 38 by the pressure pulse.

Since more fuel will be displaced by the high pressure pump than is needed just to repressurise the fuel column associated with the next injection nozzle to receive fuel, some fuel will of necessity need to be supplied directly to the pumping chamber from the low pressure pump. This tends to take place after the piston 38 has been displaced against the action of the spring 39 and during this period there is practically no movement of the piston 38 under the action of the spring in view of the size of the piston and the restrictive nature of the restrictor.

The valve 25 allows the low pressure pump 23 to partly charge the accumulator chamber when the apparatus has been at rest for some considerable period of time.

The restrictor may be replaced by a valve which is lightly spring loaded to the open position which will close when the depressurization of fuel takes place.

I claim:

1. A fuel pumping apparatus for supplying fuel to an internal combustion engine comprising an accumulator chamber, a rotary distributor member housed within a body, a delivery passage formed in the distributor member, the delivery passage registering with outlet ports in turn as the distributor member rotates, valve means positioned in a passage connecting said delivery passage with the accumulator chamber, said valve means in a first position connecting the accumulator chamber to the delivery passage to cause delivery of fuel through one of said outlet ports and in a second position breaking the communication with the accumulator chamber and establishing communication between the delivery passage and a drain channel, a cam actuated plunger pump for charging the accumulator chamber with fuel under pressure, a first valve connecting the plunger pump to the accumulator chamber, a second valve through which fuel can be supplied to the plunger pump from a low pressure pump and means for varying the quantity of fuel which is supplied to the plunger pump, a cylinder, a piston slidable in the cylinder, one end of the cylinder being connected to the plunger pump through said second valve and the other end of said cylinder being connected to said drain channel, flow restricting means in said drain channel downstream of the connection with the other end of the cylinder, said valve means being arranged to be moved from its first position to its second position to terminate delivery of fuel to the engine during the period said second valve is open.

2. An apparatus according to claim 1, including a non-return valve positioned to prevent flow of fuel from said one end of the cylinder and the low pressure pump.

3. An apparatus according to claim 2, in which said second valve comprises a port formed in said body and a plurality of passages in the distributor member, said passages communicating with the plunger pump and registering with said port in turn during the filling period.

4. An apparatus according to claim 3, in which the means for varying the quantity of fuel supplied to the plunger pump comprises an adjustable metering valve which is connected intermediate the non-return valve and the outlet of the low pressure pump.

5. An apparatus according to claim 1, including a spring biasing the piston away from said one end of the cylinder.

6. An apparatus according to claim 4, in which said flow restricting means comprises a lightly loaded non-return valve.

* * * * *